US007381011B2

(12) United States Patent
Bogle

(10) Patent No.: US 7,381,011 B2
(45) Date of Patent: Jun. 3, 2008

(54) LUBRICATION SYSTEM FOR PILE AND METHOD OF USING THE SAME

(75) Inventor: Karl E. Bogle, Edwardsville, IL (US)

(73) Assignee: MKT Manufacturing, Inc., St. Louis, MO (US)

( * ) Notice: Subject to any disclaimer, the term of this patent is extended or adjusted under 35 U.S.C. 154(b) by 11 days.

(21) Appl. No.: 11/414,090

(22) Filed: Apr. 28, 2006

(65) Prior Publication Data

US 2006/0251479 A1 Nov. 9, 2006

Related U.S. Application Data

(60) Provisional application No. 60/679,272, filed on May 9, 2005.

(51) Int. Cl.
*E21B 7/26* (2006.01)

(52) U.S. Cl. ..... 405/248

(58) Field of Classification Search ..... 405/248
See application file for complete search history.

(56) References Cited

U.S. PATENT DOCUMENTS 563,106 A * 6/1896 Washington ..... 405/248
807,456 A * 12/1905 Gilbert ..... 405/222
823,129 A 6/1906 LeFevre
955,729 A 4/1910 Welsh
1,905,643 A * 4/1933 Johnson ..... 405/13
1,907,854 A 5/1933 Moran
2,673,453 A * 3/1954 Templeton ..... 405/248
3,379,265 A 4/1968 Geiger
3,815,374 A 6/1974 Hogan
3,889,482 A * 6/1975 Frederick ..... 405/274
4,257,722 A 3/1981 Nakajima
4,499,954 A 2/1985 Diggle
4,659,257 A 4/1987 Verstraeten
4,874,270 A 10/1989 Bodine
4,909,673 A 3/1990 Barthelemy et al.

OTHER PUBLICATIONS

Lindsey J. Phares; "Grouting Piles While Driving"; Offshore Technology Conference; May 1974; 8 pages.
Grundoram Used to Install Gasoline Pipeline: Traffic Continues to Flow; On location with TT Technologies; undated, 2 pages, TT Technologies, Inc., Aurora, IL.

* cited by examiner

*Primary Examiner*—John Kreck
(74) *Attorney, Agent, or Firm*—Senniger Powers LLP

(57) ABSTRACT

A device for being driven into an earthen surface. The device includes a lubrication system having a manifold. The manifold includes first orifices that deliver lubricant to the interior space of the pile body. The first orifices are spaced around a 360-degree circumference of a lower end of the device body at intervals no greater than about 50% of the 360-degree circumference. The manifold also includes second orifices that deliver lubricant to the exterior surface of the device body. The second orifices are spaced around a 360-degree circumference of a lower end of the pile body at intervals no greater than about 50% of the 360-degree circumference.

12 Claims, 15 Drawing Sheets

LUBRICATION SYSTEM FOR PILE AND METHOD OF USING THE SAME

BACKGROUND OF INVENTION

This invention relates generally to a device of the type for being driven into an earthen surface, and more particularly to such a device having a lubricating system and a method of using the same.

The driving of a device into the earth involves substantial frictional forces. For example, one type of device is a pile casing having a tubular body that is driven into the earth to form and stabilize a bore hole which will be filled with cement and rebar to form a pile. The interior of the casing body fills with earthen material called a plug as the casing is driven down. Thus, frictional forces are generated both on the inside and the outside of the casing as it moves down through the soil. Lubrication systems have been developed to reduce these frictional forces, typically by applying a liquid lubricant to the casing. However, conventional systems apply such lubricant either to the exterior surface or to the interior surface (if applicable) of the casing, but not to both surfaces.

SUMMARY OF THE INVENTION

In general, the present invention relates to a pile casing for being driven into an earthen surface. The casing includes a tubular casing body having a length, an upper end, a lower end, a 360-degree circumference adjacent its lower end, an exterior surface, and an interior surface defining an interior space. The casing also includes a lubrication system. The lubrication system includes a conduit for transferring lubricant running along the length of the casing body and having a first end adapted for fluid communication with a source of lubricant and a second end. A manifold adjacent the lower end of the casing body defines a manifold chamber around the exterior surface of the casing body. The manifold chamber is in fluid communication with the second end of the conduit for flow of lubricant into the manifold chamber. The lubrication system includes a plurality of first orifices for delivery of lubricant from the manifold chamber to the interior space. The first orifices are spaced around the 360-degree circumference of the casing body at intervals no greater than about 50% of the 360-degree circumference. The lubrication system also includes a plurality of second orifices for delivery of lubricant from the manifold chamber to the exterior surface of the casing body. The second orifices are spaced around the 360-degree circumference of the casing body at intervals no greater than about 50% of the 360-degree circumference. The arrangement is such that lubricant delivered to the manifold chamber is delivered through the first and second orifices for distribution to the interior space and the exterior surface of the casing body to facilitate driving of the casing.

In another aspect, the present invention relates to a device for being driven into an earthen surface. The device includes an elongate body having a length, a cross-sectional shape, an upper end, and a lower end terminating in a bottom edge. The device also includes a lubrication system. The lubrication system includes a conduit running along the length of the body for delivering lubricant. The conduit has a first end adapted for fluid communication with a source of lubricant and a second end. A manifold cap capping the lower end of the body has a shape generally corresponding to the cross-sectional shape of the body. The cap has a top formed with a slot for receiving the bottom edge of the body, a bottom for contacting the earthen surface as the body is driven into the earthen surface, and opposite sides. A manifold chamber inside the manifold cap is in fluid communication with the second end of the conduit and has a shape generally corresponding to the shape of the manifold cap. A plurality of orifices in the manifold cap are adapted to deliver lubricant from the manifold chamber to the exterior of the cap to facilitate driving the device through the earthen surface.

This invention also involves a method of lubricating a pile casing as the casing is being driven into an earthen surface. A casing body has a length, an upper end, a lower end, a 360-degree circumference adjacent its lower end, an exterior surface, and an interior surface defining an interior space. The casing also includes a manifold disposed at the lower end of the casing body. The method comprises the steps of delivering lubricant to a manifold chamber of the manifold, and ejecting the lubricant from the manifold chamber of the manifold to the exterior surface of the casing body at first exit locations. The first exit locations are spaced around the 360-degree circumference adjacent the lower end of the casing body at intervals no greater than about 50% of the 360-degree circumference. The method also includes ejecting lubricant from the manifold chamber of the manifold to the interior space of the casing body at second exit locations. The second exit locations are spaced around the 360-degree circumference adjacent the lower end of the casing body at intervals no greater than about 50% of the 360-degree circumference.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DRAWINGS

Figure 1:
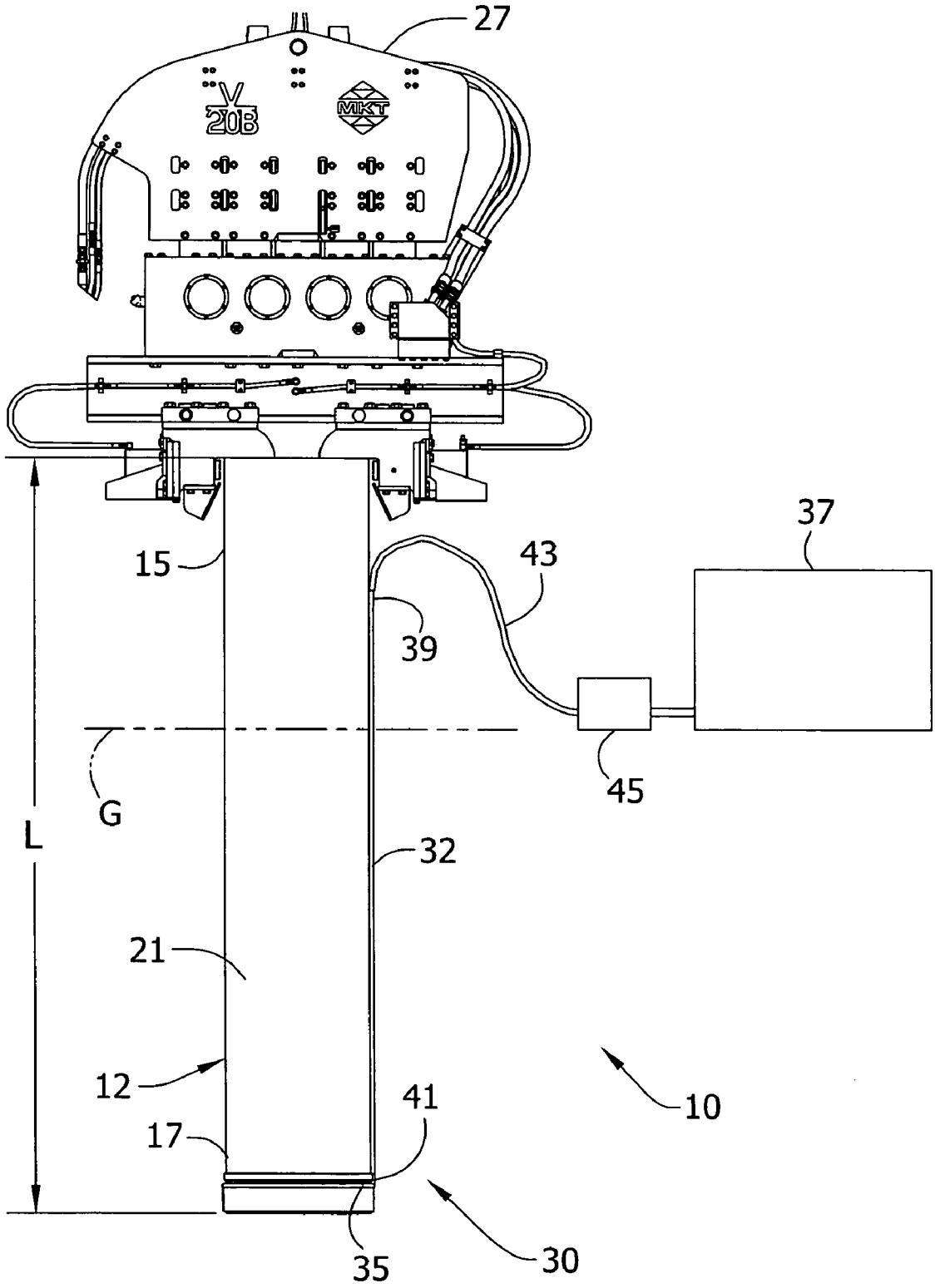
FIG. 1 is a front view of one embodiment of a pile casing of this invention.
Figure 3:
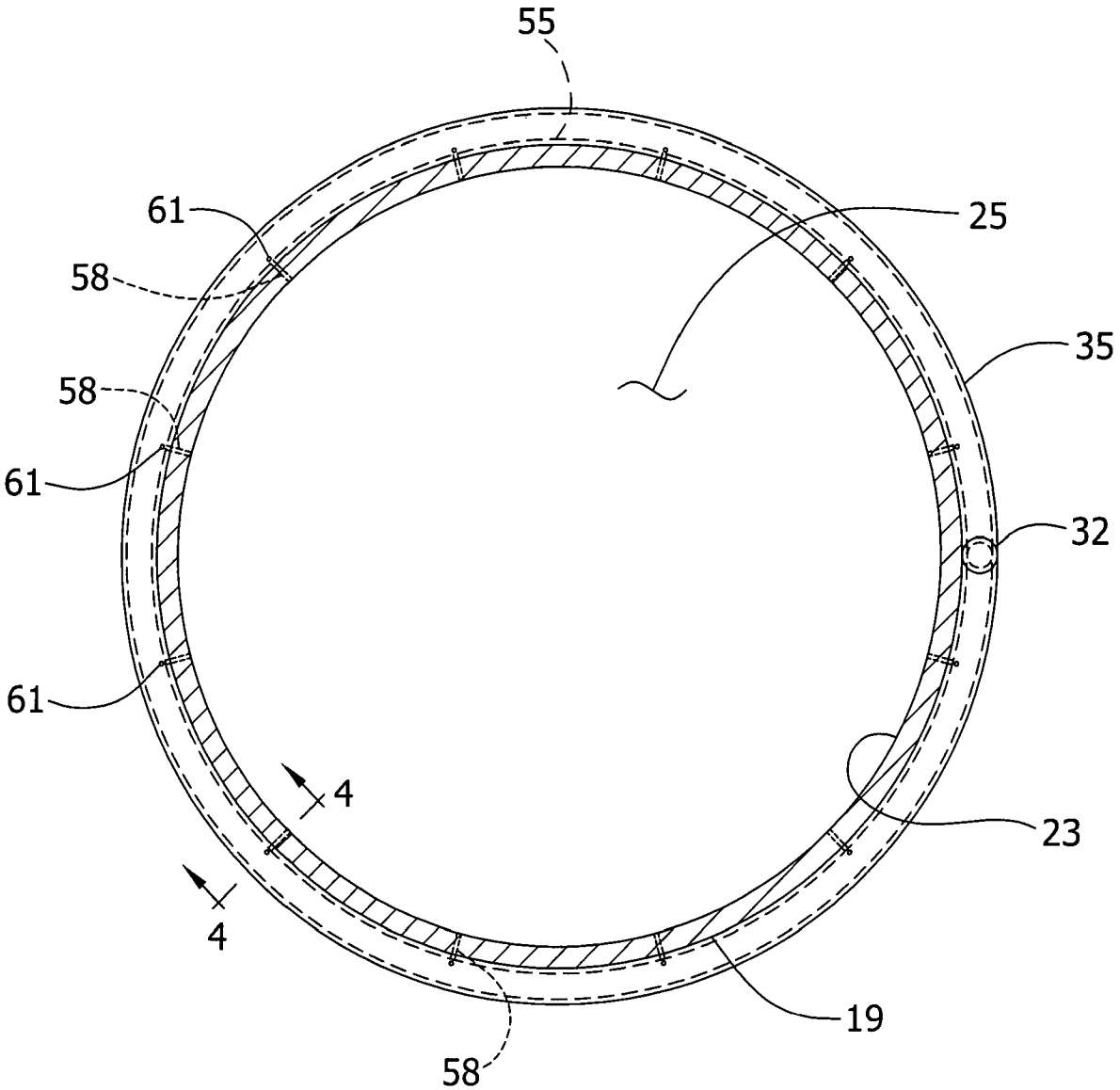
FIG. 3 is a cross-section of the lower end of the pile casing taken in a plane including the line 3-3 of FIG. 2.

Referring now to the drawings, FIG. 1 illustrates one embodiment of a device of the present invention, generally indicated at 10, for being driven into an earthen surface. The device of this embodiment is a pile casing used to create a bore hole to be filled with material, such as cement and rebar, to form a pile. The use of the casing 10 is described in more detail below. For illustrative purposes, the casing 10 is shown partially driven into an earthen surface G (shown in phantom). The pile casing 10 includes a casing body, generally indicated at 12, having a length L, an upper end 15, a lower end 17, a 360-degree circumference 19 adjacent its lower end (FIG. 3), an exterior surface 21, and an interior surface 23 defining an interior space 25 (FIG. 3). Preferably, the casing body 12 is formed from metal, although it may be formed from other materials. The casing body 12 may comprise a plurality of casing sections (not shown) that are connected end to end to form the length L of the body, or the casing body may be a one-piece structure. In one embodiment, the casing body 12 is generally cylindric (i.e., having a circular cross-section), but it is understood that the casing body may have other cross-sectional shapes, such as oval, square, rectangular, H-shaped, Z-shaped, and L-shaped, falling within the scope of this invention. A vibratory hammer 27 for driving the casing 10 into the earthen surface G is attached to the upper end 15 of the casing body 12. It is understood that other devices, such as a jacking device (also called a pressing device) or an impact hammer, may be used to drive the casing 10 into the earthen surface G. The vibratory hammer 27 and the casing body 12 are conventional and well-known in the art.

The casing 10 of FIG. 1 also includes a lubrication system, generally indicated at 30. The lubrication system 30 includes a conduit 32 mounted on the exterior surface 21 of the casing body 12 and a manifold 35 mounted on the lower end 17 of the casing body 12. The conduit 32 is adapted for transferring lubricant from a lubricant source 37 to the manifold 35. Examples of lubricant to be used with the casing 10 of the present invention include water, or any water-based or synthetic drilling fluid. The conduit 32 is preferably metal and is attached to the casing body 12 by suitable means, such as by welding. The conduit 32 may be formed from other materials and may be attached to the casing body 12 in other ways. The cross-sectional area of the conduit 32 is preferably between about 0.2 $in^2$ (129 $mm^2$) and 3.14 $in^2$ (2025 $mm^2$), but the conduit may have a larger or smaller cross-sectional area so long as it is capable of adequately transferring lubricant. The conduit 32 has a first end 39 generally adjacent the upper end 15 of the casing body 12 in fluid communication with the lubricant source 37 and a second end 41 generally adjacent the lower end 17 of the casing body in fluid communication with the manifold 35. The conduit 32 preferably runs along substantially a majority of the length L of the casing body 12 so that when the casing 10 is embedded in the earth, the first end 39 of the conduit remains above the surface G. Tubing 43, preferably flexible tubing similar to a hydraulic hose or an air hose, fluidly connects the first end 39 of the conduit 32 to a lubricant pump 45 that pumps lubricant from the lubricant source 37. Lubricant from the lubricant source 37 is pumped into the conduit 32 and transferred into the manifold 35 of the lubrication system 30. It is understood that alternative ways of providing lubricant to the conduit 32 other than by use of a pump are within the scope of this invention.

In one embodiment (FIGS. 2-5), the manifold 35 of the lubrication system 30 is a hollow annular body, preferably formed from metal, that extends around the exterior surface 21 of the casing body 12 in a direction generally transverse to the length L of the body. In the illustrated embodiment, the manifold 35 is formed from round tubular bar having a radius r (FIG. 5). It is understood that the manifold 35 may have other shapes without departing from the scope of this invention. The manifold 35 has an exterior surface 50 and an interior surface 52 (FIG. 5). The interior surface 52 defines a manifold chamber 55 that extends around the 360-degree circumference 19 adjacent the lower end 17 of the casing body 12. In one embodiment the manifold chamber 55 has a generally circular cross-section (FIG. 5). Preferably, the manifold chamber 55 has a cross-sectional area between about 0.2 $in^2$ (129 $mm^2$) and 3.14 $in^2$ (2026 $mm^2$). The manifold chamber 55 is fluidly connected to the second end 41 of the conduit 32 and accepts lubricant from the conduit. The manifold 35 is attached to the casing body 12 adjacent its lower end 17 by welding or by any other means that adequately secures the manifold to the body.

Figure 4:
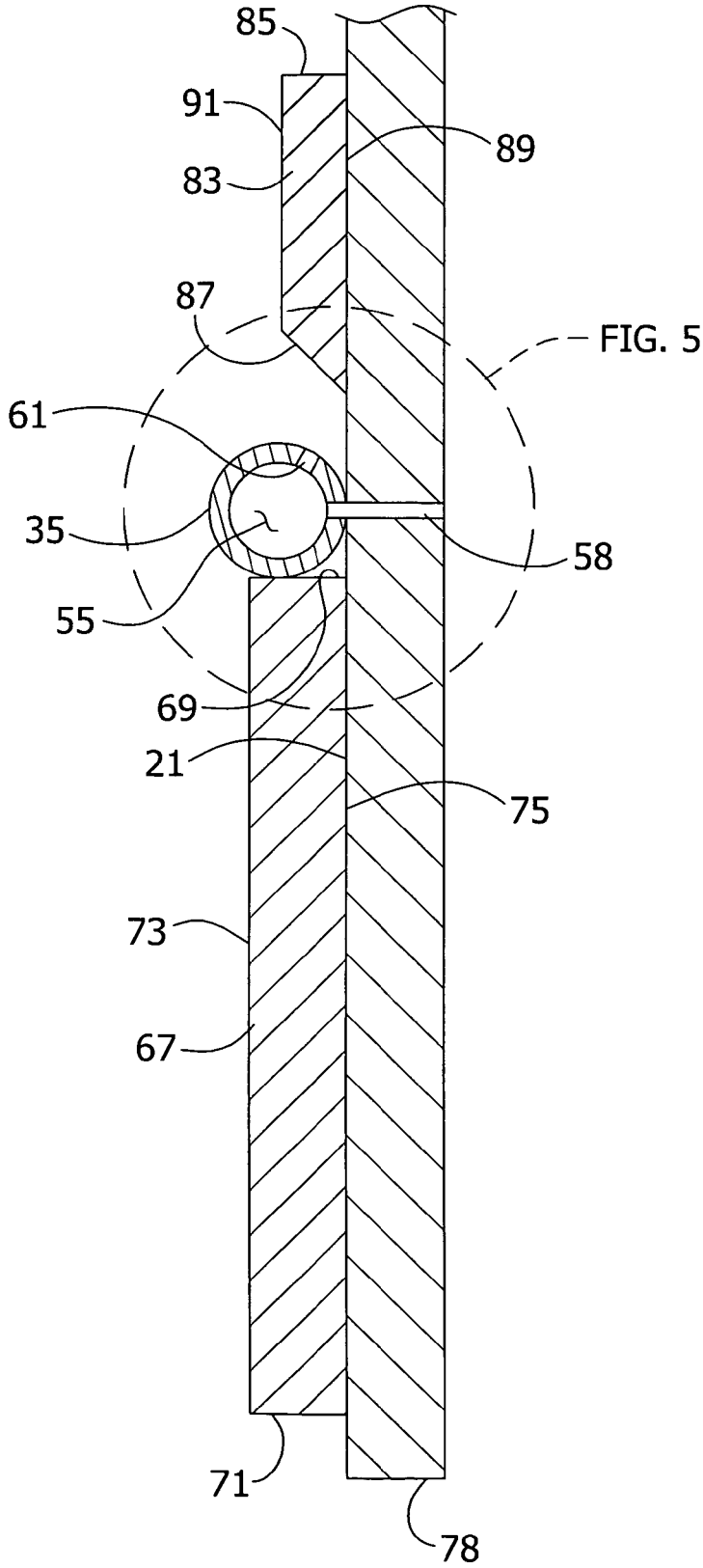
FIG. 4 is partial longitudinal section of the lower end of the pile casing taken in a plane including the line 4-4 of FIG. 2.
Figure 5:
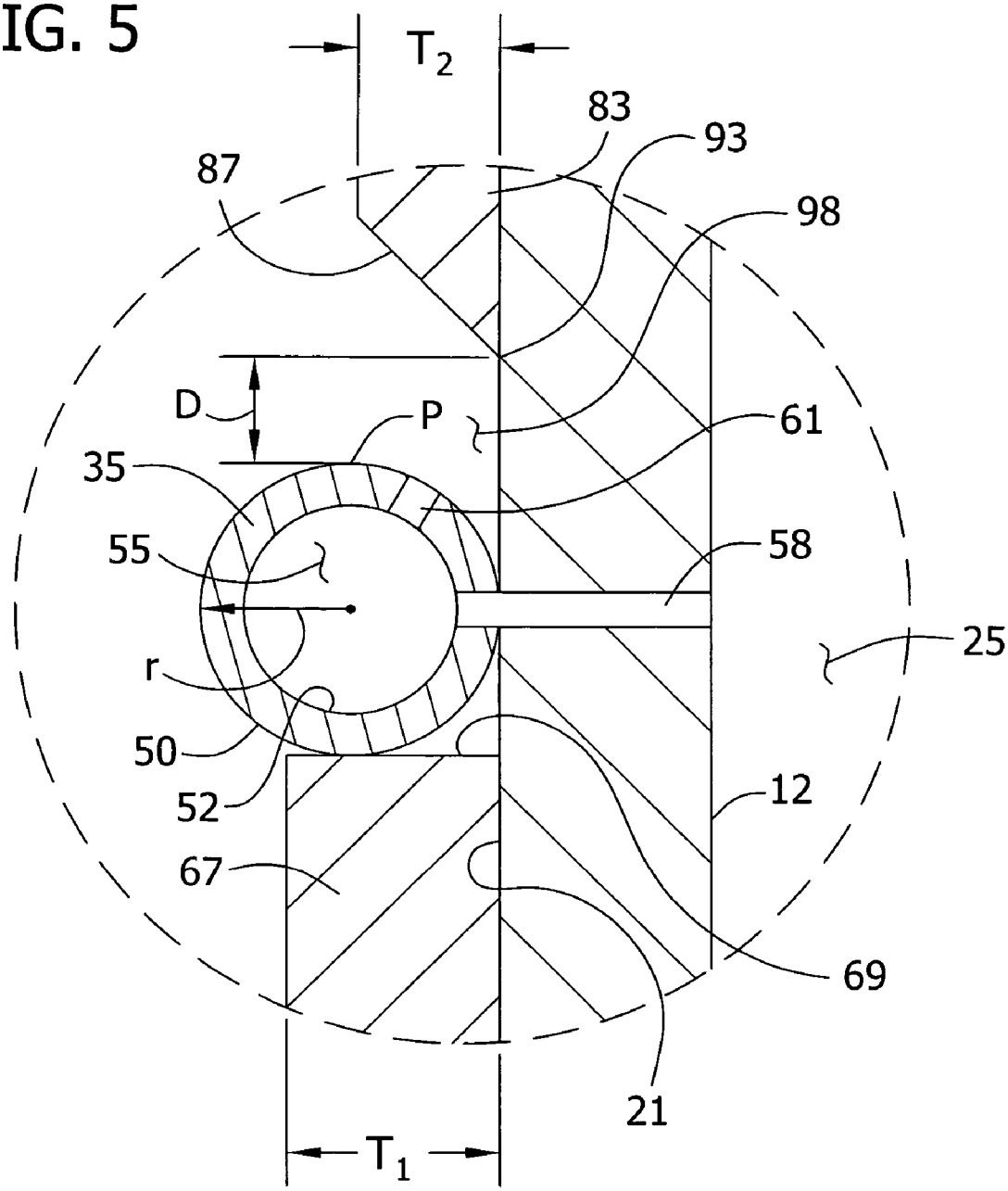
FIG. 5 is an enlarged partial view of FIG. 4.
Figure 6:
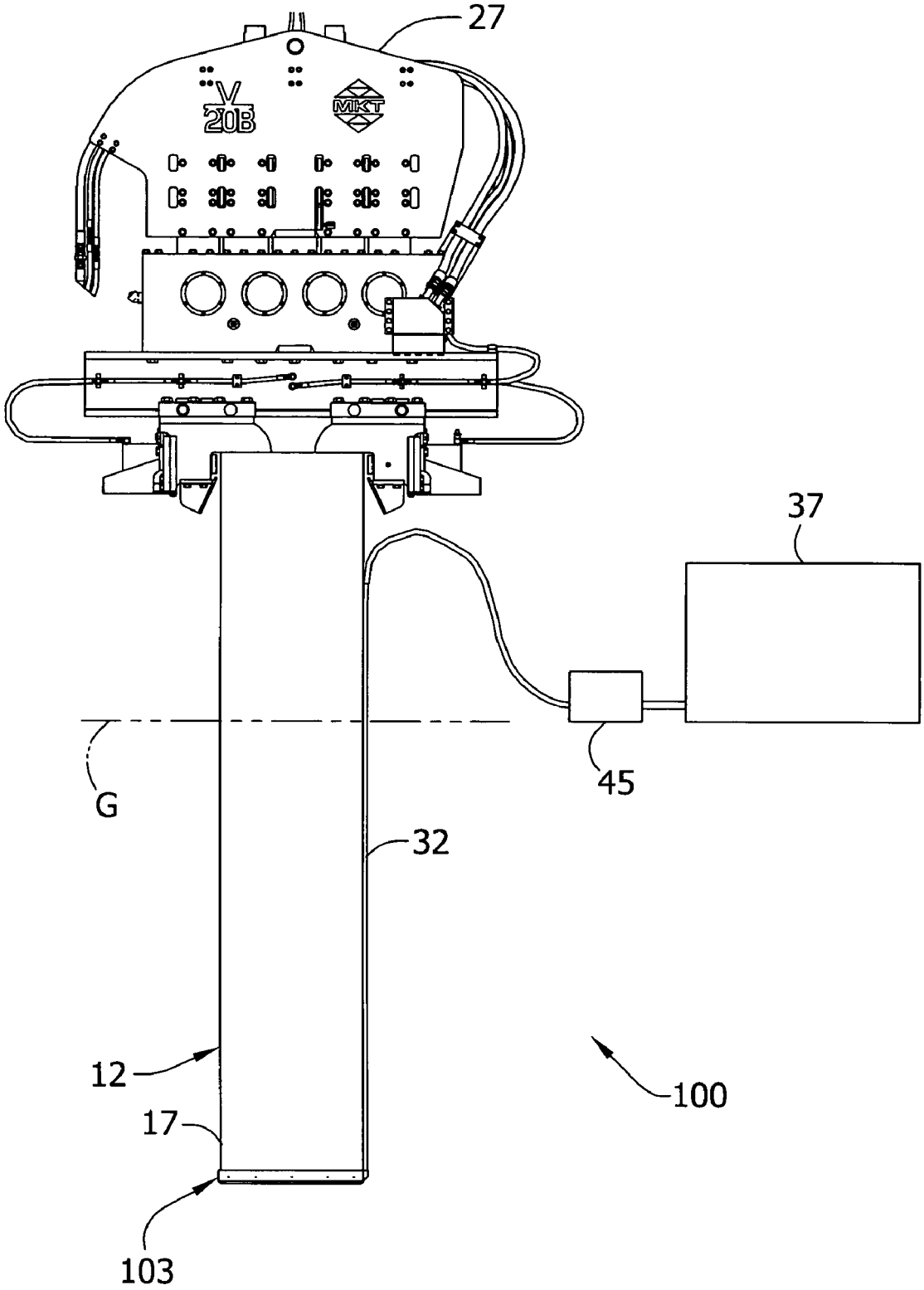
FIG. 6 is a front view of another embodiment of a pile casing of this invention.
Figure 7:
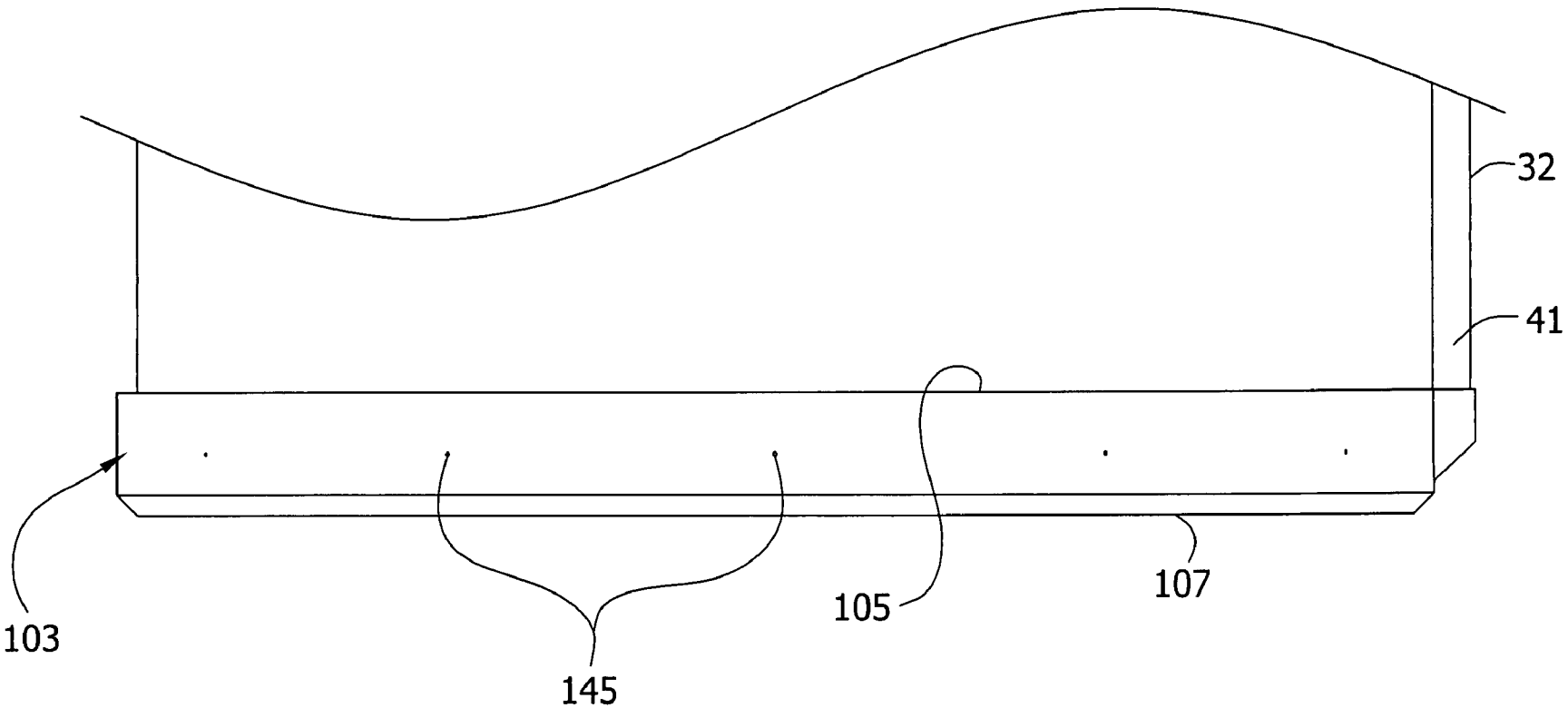
FIG. 7 is an enlarged fragmentary view of a lower end of the pile casing of FIG. 6.

As shown best in FIGS. 3-5, a plurality of first orifices 58 extend from the manifold chamber 55 to the interior space 25 of the casing body 12 to deliver lubricant from the manifold chamber 55 to the interior space of the body. In one embodiment, the first orifices 58 are generally circular in shape, but it is understood that these orifices may have other shapes without departing from the scope of this invention. Preferably, each of the first orifices 58 has a cross-sectional area between about 0.00075 $in^2$ (0.484 $mm^2$) and 0.20 $in^2$ (129 $mm^2$), but it is understood that this area may vary, so long as the orifices deliver lubricant from the manifold chamber 55 to the interior space 25 of the casing body 12 at an adequate or desired rate. The first orifices 58 are spaced around the 360-degree circumference 19 adjacent the lower end 17 of the casing body 12 preferably at intervals no greater than about 50% of the 360-degree circumference, more preferably at intervals no greater than about 40% of the 360-degree circumference, more preferably at intervals no greater than about 30% of the 360-degree circumference, more preferably at intervals no greater than about 25% of the 360-degree circumference, more preferably at intervals no greater than about 20% of the 360-degree circumference, more preferably at intervals no greater than about 15% of the 360-degree circumference, more preferably at intervals no greater than about 10% of the 360-degree circumference, and even more preferably at intervals no greater than about 5% of the 360-degree circumference. Moreover, the distance between adjacent orifices 58 is preferably between about 1 inch (2.54 cm) and 12 inches (30.5 cm) to provide an adequate amount of lubricant around the 360-degree circumference. It is understood, however, that the distance between adjacent orifices 58 may vary without departing from the scope of this invention.

The manifold 35 has a plurality of second orifices 61 therein for delivery of lubricant from the manifold chamber 55 to the exterior surface 21 of the casing body 12. In one embodiment, the second orifices 61 are generally circular in shape, but it is understood that these orifices may have other shapes without departing from the scope of this invention. Preferably, each of the second orifices 61 has an area between about 0.00075 $in^2$ (0.484 $mm^2$) and 0.20 $in^2$ (129 $mm^2$), but it is understood that this area may vary, so long as they adequately deliver lubricant from the manifold chamber 55 to the exterior surface 21 of the casing body 12. As illustrated in FIG. 5, the second orifices 61 are preferably located on an upper portion 63 of the manifold 35 and are angled towards the casing body 12 such that the orifices direct lubricant toward the casing body. The second orifices 61 are spaced around the 360-degree circumference 19 of the casing body 12 preferably at intervals no greater than about 50% of the 360-degree circumference, more preferably at intervals no greater than about 40% of the 360-degree circumference, more preferably at intervals no greater than about 30% of the 360-degree circumference, more preferably at intervals no greater than about 25% of the 360-degree circumference, more preferably at intervals no greater than about 20% of the 360-degree circumference, more preferably at intervals no greater than about 15% of the 360-degree circumference, more preferably at intervals no greater than about 10% of the 360-degree circumference, and more preferably at intervals no greater than about 5% of the 360-degree circumference. Moreover, the distance between adjacent orifices 61 is preferably between about 1 inch (2.54 cm) and 12 inches (30.5 cm) to provide an adequate amount of lubricant around the 360-degree circumference. It is understood, however, that this distance may vary without departing from the scope of this invention.

Figure 2:
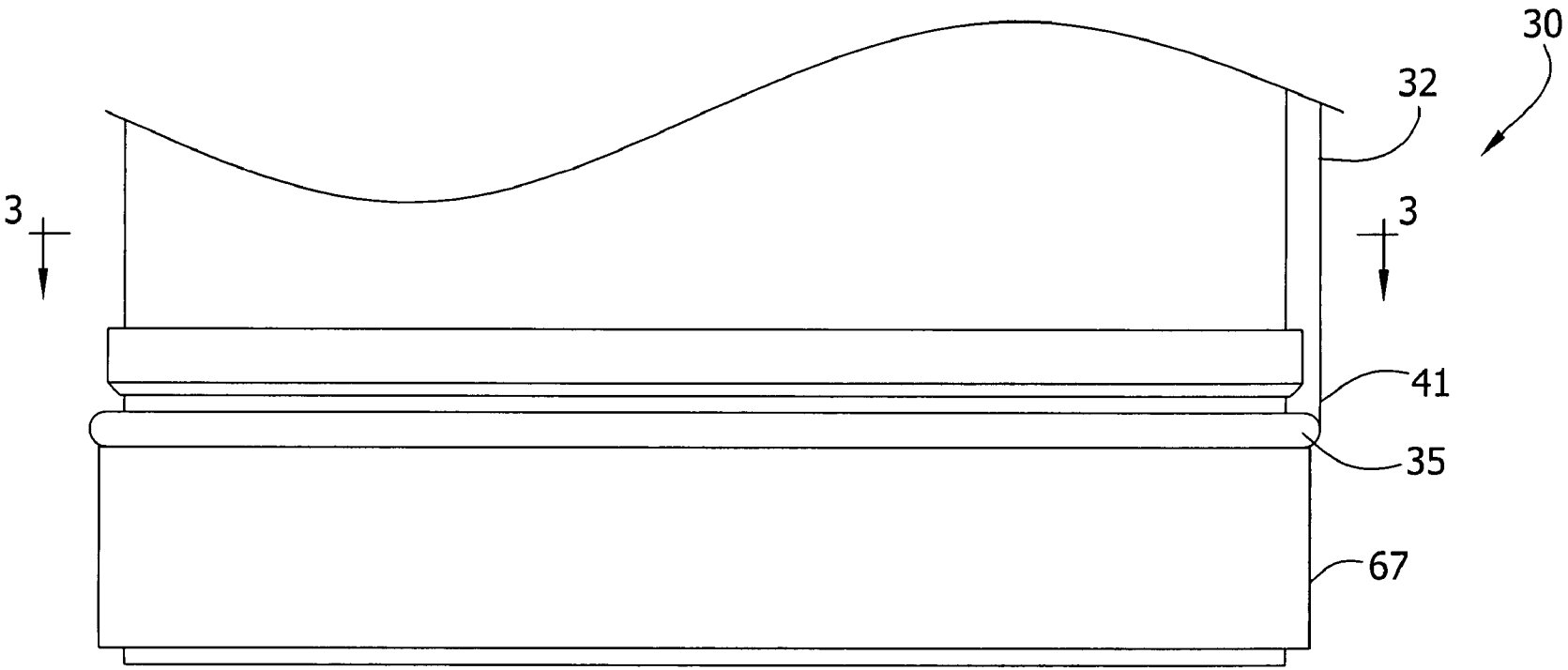
FIG. 2 is an enlarged fragmentary view of a lower end of the pile casing of FIG. 1.

In the embodiment of FIGS. 2, 4 and 5, the casing 10 includes a lower protective guard 67 attached to the exterior surface 21 of the casing body 12 below the manifold 35. In this embodiment, the guard 67 is formed as a generally cylindric ring having a shape and size corresponding to that of the casing body 12. The guard 67 has a top surface 69, a bottom surface 71, an exterior surface 73, and an interior surface 75. The guard 67 may be formed from metal and welded to the casing body 12, or it may be formed from other materials attached in other ways. As described in more detail below, the guard 67 protects the manifold 35 as the casing 10 is driven into the earth. In one embodiment, the top surface 69 of the guard 67 contacts a lower portion of the manifold 35 and the bottom surface 71 of the guard is disposed generally adjacent a bottom surface 78 or edge of the casing body 12 (FIG. 4). Preferably, the lower portion of the manifold 35 is attached, such as by welding or any other suitable means, to the top surface 69 of the guard 67 to give the manifold 35 additional support. The guard 67 also has a thickness $T_1$ (FIG. 5) projecting generally radially outward from the exterior surface 21 of the casing body 12. As shown best in FIG. 5, in one embodiment, the thickness $T_1$ of the guard 67 (at least at the top surface 69 of the guard) is greater than the radius r of the manifold 35 to ensure that the manifold is adequately protected as the casing 10 is driven into the earth.

The casing 10 also includes an upper protective guard 83 attached to the exterior surface 21 of the casing body 12 at a location above the manifold 35. In one embodiment (FIGS. 2, 4 and 5), the upper guard 83 is generally ring-shaped to correspond to a casing body 12 of tubular shape. The upper guard 83 has a top surface 85, a bottom surface 87, an interior surface 89, and an exterior surface 91. In this embodiment, the bottom surface 87 tapers toward the casing body 12 for reasons discussed below. A lowermost edge 93 (FIG. 5) of the upper guard 83 is preferably spaced a distance D from an uppermost point P on the exterior surface 50 of the manifold 35, as shown in FIG. 5. Preferably, the distance D is between about 0.25 inches (0.635 cm) and 2 inches (5.08 cm). The upper guard 83 may be formed from metal and welded to the casing body 12, or it may be formed from other materials attached in other ways. The guard 83 has a thickness $T_2$ projecting radially from the exterior surface 21 of the casing body 12 such that the guard preferably overlies the second orifices 61 of the manifold 35. Accordingly, the thickness $T_2$ of the upper guard 83 at least at the lower edge 93 of the guard is preferably greater than the distance between the second orifices 61 and the casing body 12. This arrangement creates a recess 98 between the second orifices 61 and the upper guard 83 into which lubricant is ejected from the second orifices. The tapered bottom surface 87 allows lubricant ejected onto the guard 83 to flow upward toward the top surface 85 of the guard and onto the upper end 15 of the casing body 12 as the casing 10 is being driven into the earth. This configuration allows lubricant to be adequately applied to the exterior surface 21 of the casing body 12 and substantially prevents earthen debris from clogging the second orifices 61 as the casing 10 is retracted from the earth. The upper guard 83 also protects the manifold 35 as the casing 10 is retracted from the earth.

In use, a manifold 35 and a conduit 32 of the present invention, as described above, are installed on a conventional tubular casing body 12. The manifold 35 and the conduit 32 may be retrofitted on an existing casing body 12, or the manifold and the conduit may be installed on the casing body at the time of manufacture. Flexible tubing 43 attached to a lubricant pump 45 is connected to the conduit 32. A crane is used to erect the casing 10 and to attach a vibratory hammer 27 to the upper end 15 of the casing body 12. The vibratory hammer 27 and the lubricant pump 45 are activated such that lubricant from the lubricant source 37 is ejected into the interior space 25 of the casing body 12 and on the exterior surface 21 of the casing body as the casing 10 is being driven into the earth. Lubricant is ejected into the interior space 25 of the casing body 12 from the first orifices 58 to reduce the friction between the earthen plug and the interior surface 23 of the casing body. Lubricant is also ejected from the second orifices 61 to the exterior surface 21 of the casing body 12 to reduce friction between the exterior surface of the casing body and the earth through which the casing 10 is being driven. The earthen plug is removed from the inside of the casing 10, and the casing is filled with material, such as cement and rebar, to form a pile. The casing may then be retracted, leaving the formed pile, or it may be left in the ground as part of the pile.

Because of the reduced friction, less force is required to drive the casing 10, or alternatively, the same amount of force applied to the casing will drive the casing faster and further into the earthen surface than without lubrication. Accordingly, using the present invention, the casing 10 may be used to form a relatively deep bore hole whereas using a conventional casing, such as a casing without a lubrication system or a casing with a lubrication system that lubricates only one of the inside and outside of the casing, may not have been economically feasible or even physically possible because of the difficulties in driving these types of casings into the earth to certain depths. Moreover, the lubricant reduces soil resistance to vibration, making the vibratory hammer 27 more effective at driving the casing 10. Moreover still, not only is it easier to drive the casing 10 into the earth, but it is also easier to retract the casing, if necessary, because the exterior surface 21 of the casing body 12 is well lubricated. Likewise, the plug of earthen material inside the casing body 12 is removed faster and easier because the interior surface 23 is well lubricated. Overall, the process is efficient and money is saved because the steps of driving and retracting the casing 10 consume less time and energy than conventional techniques.

Preferably, the earthen surface is analyzed before the casing 10 is driven into it. Depending on the characteristics of the earthen surface, the type of lubricant to be used is determined. The flow rate of the lubricant to the interior space 25 and the exterior surface 21 of the casing body 12 is calculated such that the overall friction between the casing body and the earth is minimized. These steps help to maximize the overall efficiency of the process.

The casing 10 of the present invention derives other advantages because of the decreased friction created by the lubrication system 30 of the present invention. For example, the casing 10 has an extended life compared to conventional casings because of less friction wear. Moreover, the bore hole created by the casing 10 is of a higher quality and the face of the hole has more stability than conventional techniques that do not use a casing, such as the use of a slurry material that coats the wall of the bore hole that is well known in the art.

Figure 11:
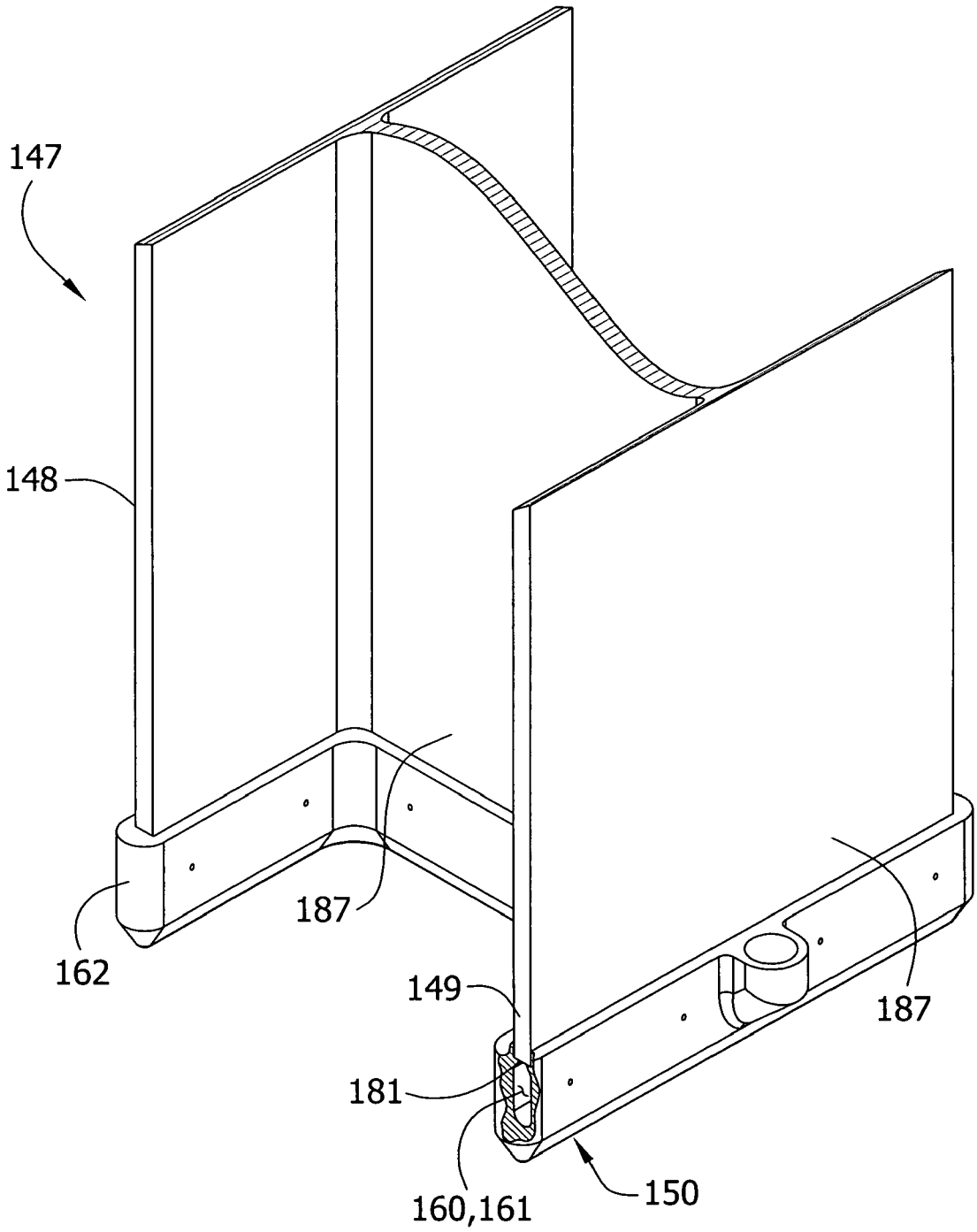
FIG. 11 is a fragmentary perspective of one embodiment of an H-shaped pile.
Figure 12:
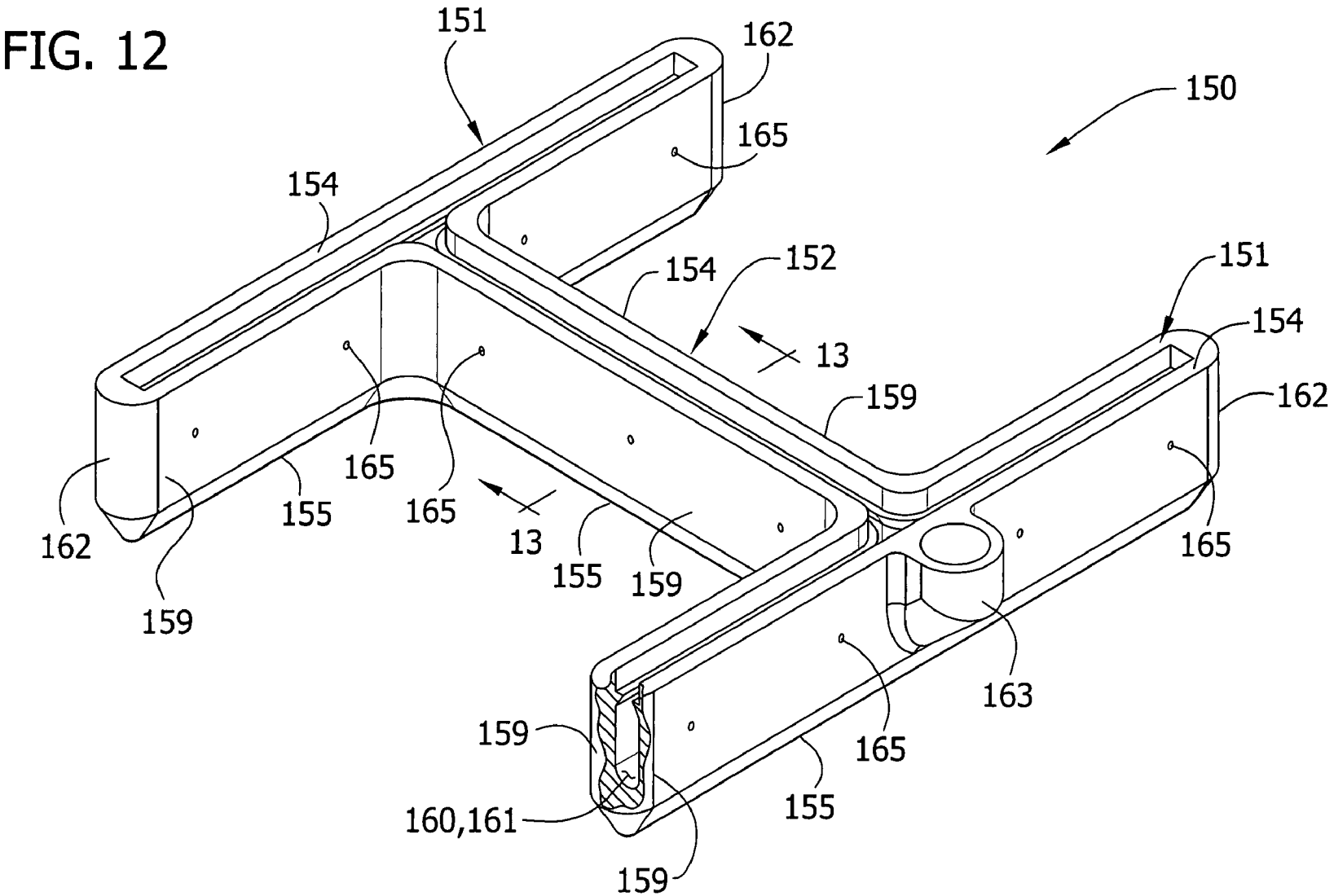
FIG. 12 is a perspective of a manifold cap of the H-shaped pile of FIG. 11.
Figure 13:
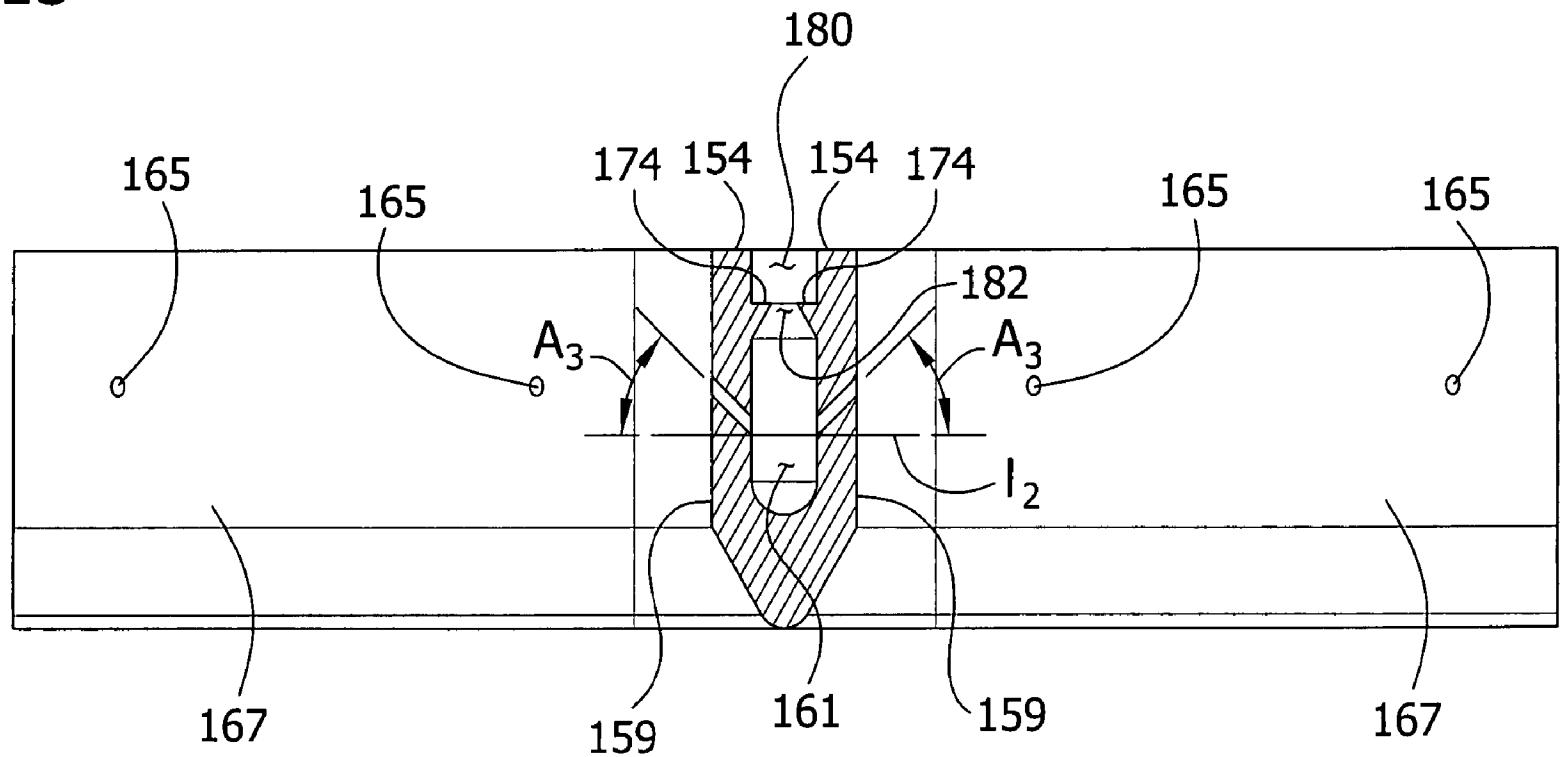
FIG. 13 is a cross-section of the manifold cap taken in the plane including the line 13-13 of FIG. 12.

Referring now to FIGS. 6-10, another embodiment of a device of the present invention for driving into the earth is generally indicated at 100. The device 100 of this embodiment is a pile casing substantially identical to the pile casing 10 shown in FIGS. 1-5, except that this casing includes a manifold cap, generally designated at 103, capping the lower end 17 of the casing body 12, instead of the tubular manifold 35 and lower and upper protective guards 67, 83, respectively, described above. Because the casing shown in FIGS. 6-10 is similar to the casing 10 shown in FIGS. 1-5, corresponding parts are indicated by corresponding reference numbers for convenience. The manifold cap 103 has a top 105, a bottom 107, and a manifold chamber 113 inside the cap in fluid communication with the second end 41 of the conduit 32. A port 115 extending generally laterally from the outer side of the cap 103 fluidly connects the manifold chamber 113 and the conduit 32. Preferably, the manifold cap 103 has a shape generally corresponding to the cross-sectional shape of the associated casing body 12. In one embodiment, the manifold cap 103 is generally ring-shaped corresponding to the cross-sectional shape of the casing body 12. However, as shown in FIGS. 11-13 and as will be described below when discussing other embodiments, the manifold cap 103 is suitable for use with types of devices other than pile casings, for example, piles.

Because the manifold cap 103 caps the lower end 17 of the casing body 12, the bottom 107 of the manifold cap corresponds to the bottom of the casing 100, and therefore, it is the leading part of the casing as the casing is driven into the earth. In one embodiment (FIGS. 7 and 9), the annular bottom 107 of the manifold cap 103 is tapered such that the bottom forms a generally V-shaped tip. The taper aids in driving the casing 100 into the earth. Other bottom configurations are within the scope of the invention.

Figure 8:
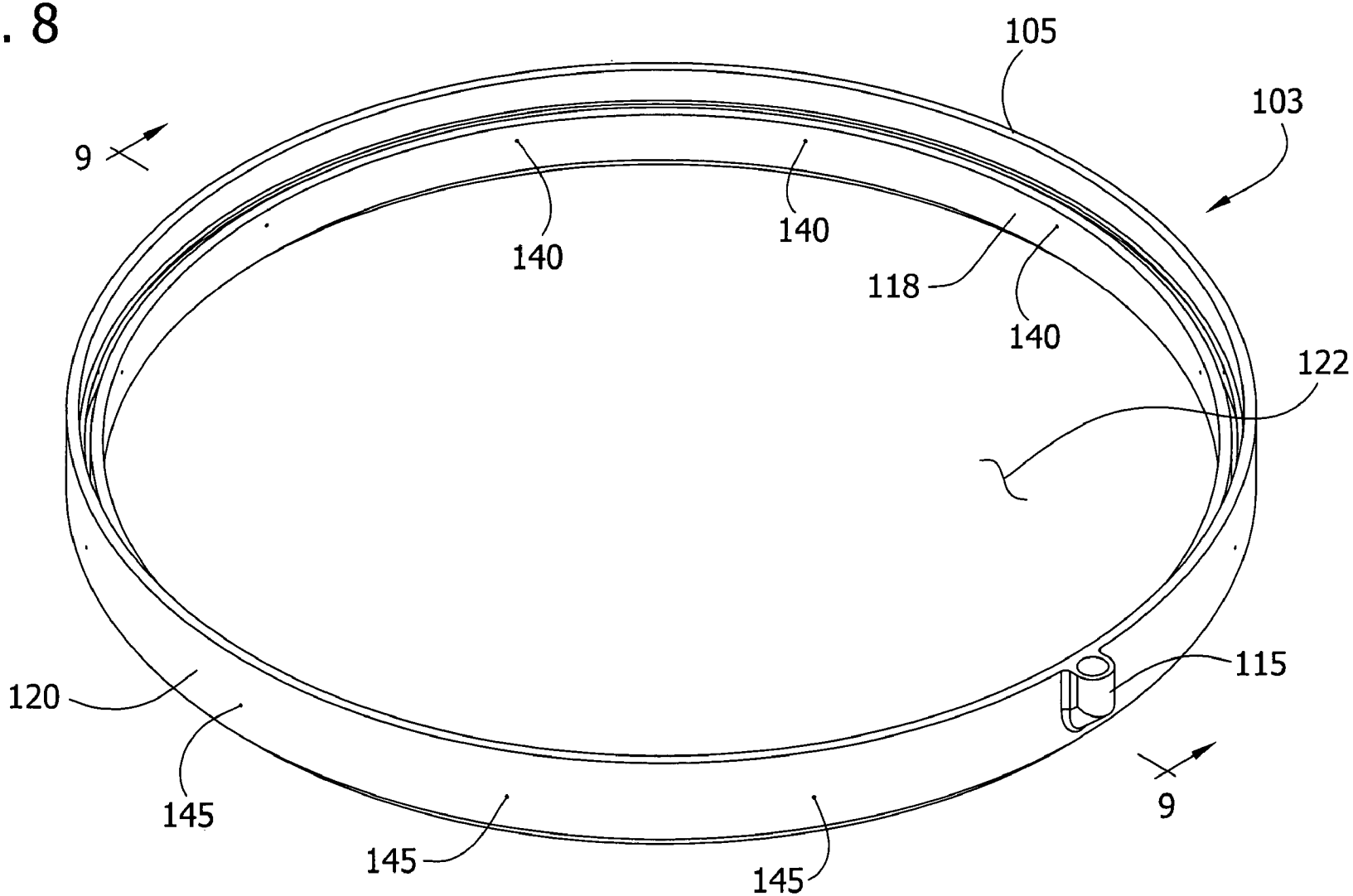
FIG. 8 is a perspective of a manifold cap of the pile casing of FIG. 6.
Figure 9:
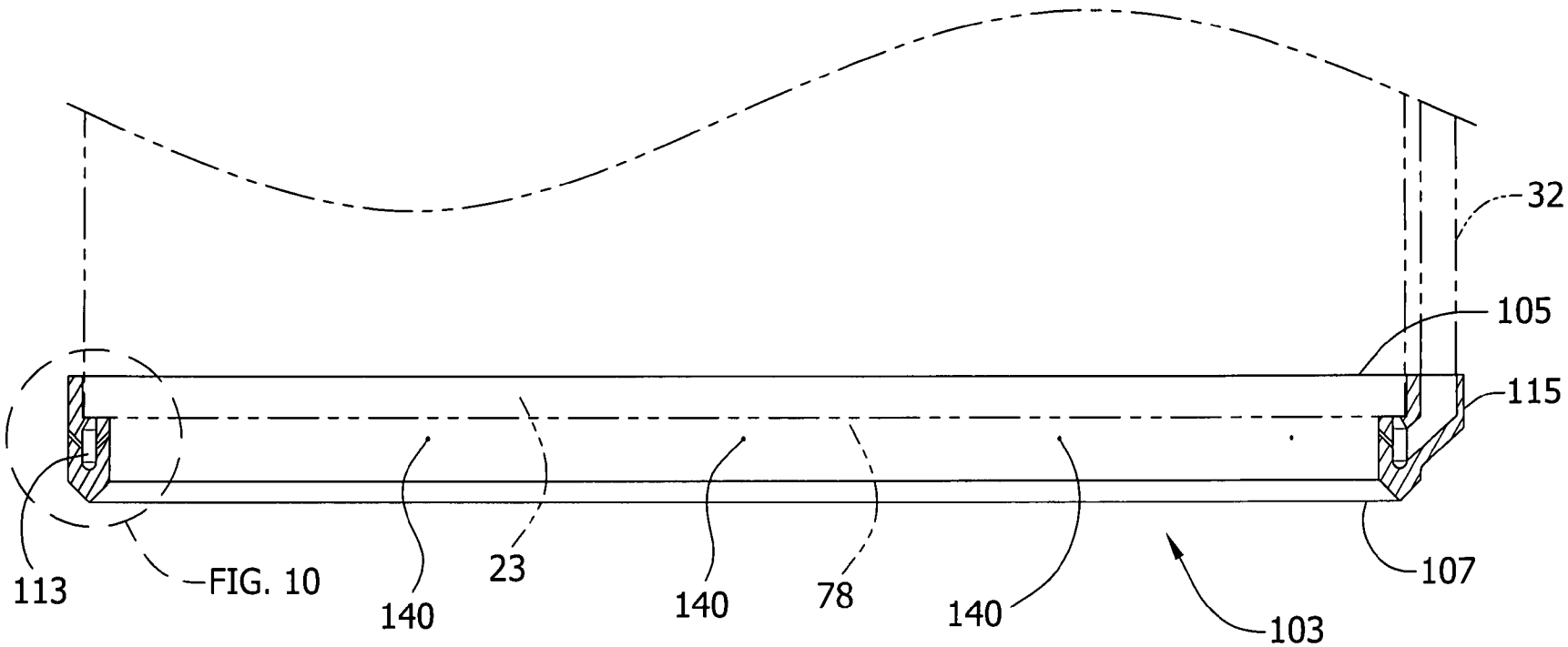
FIG. 9 is a cross-section of the manifold cap taken in the plane including the line 9-9 of FIG. 8.
Figure 10:
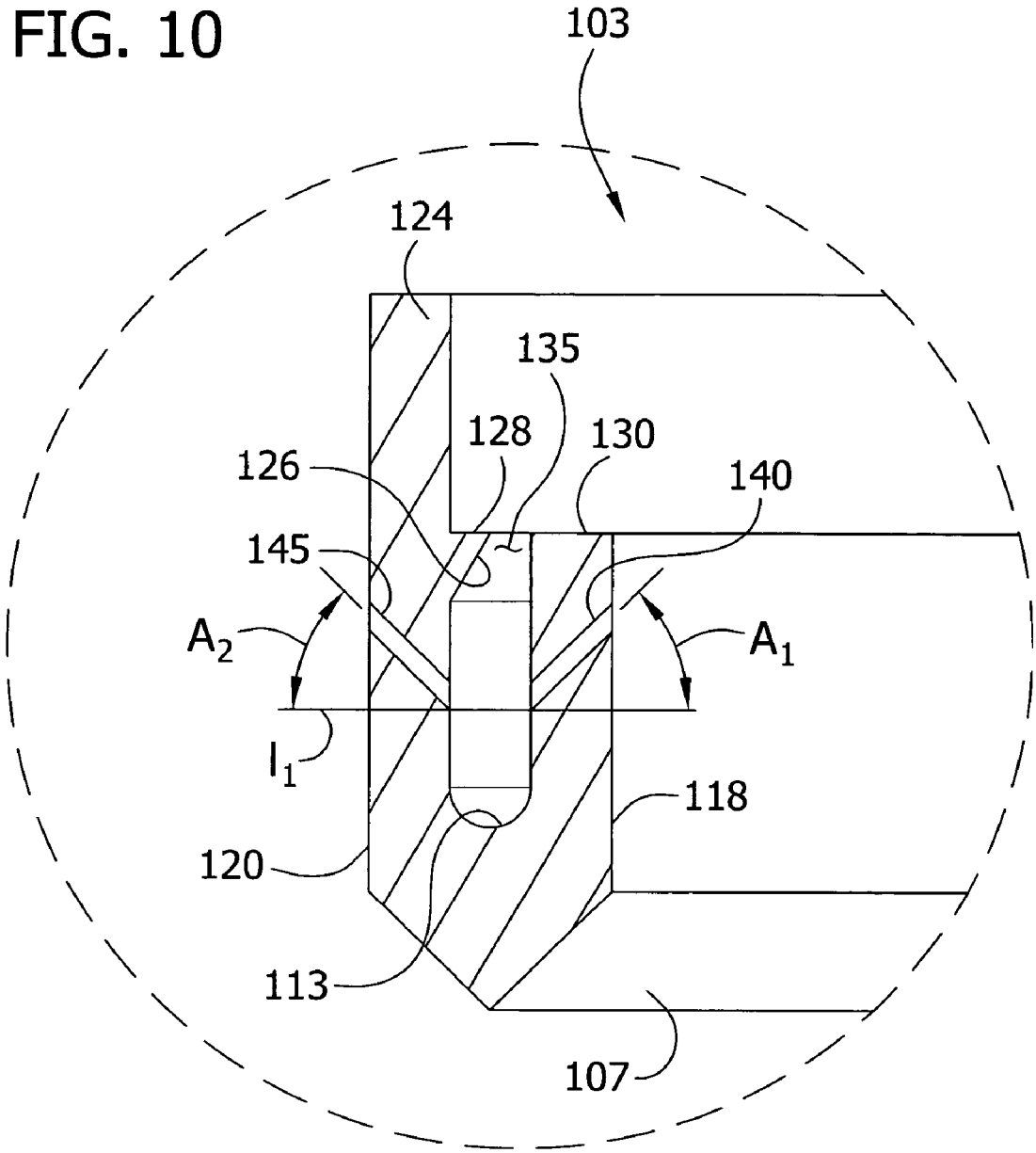
FIG. 10 is an enlarged partial view of FIG. 9.

In the embodiment shown in FIGS. 8-10, a pair of spaced apart side walls 118, 120, respectively, bound the manifold chamber 113 and form opposite sides of the manifold cap 103. The inner side wall 118 also defines an interior cap area, designated 122. As shown best in FIG. 10, the outer side wall 120 has an upper portion 124 that extends higher than the inner wall 118. A ledge 126 or shoulder extends from the outer wall 120 into the chamber 113 and has a top 128 that is generally coplanar with a top 130 of the inner wall 118. When the cap 103 is attached to the casing 100, a bottom surface 78 (FIG. 9) or edge of the casing body 12 contacts and lies generally flush against the top 128 of the ledge 126 and the top 130 of the inner wall 118, thereby closing a top opening 135 of the channel-shaped chamber 113. The inner wall 118 is generally flush with the interior surface 23 of the casing body 12, and the upper portion 124 of the outer wall 120 overlaps the exterior surface 21 of the casing body (FIG. 9). Preferably, the cap 103 is welded to the lower end 17 of the casing body 12, although other ways of attaching the cap to the casing body are within the scope of the invention.

In one embodiment (FIG. 8-10), a plurality of first orifices 140 are disposed in the inner wall 118 of the manifold cap 103. The first orifices 140 extend from the manifold chamber 113 to the interior cap area 122 defined by the inner wall 118 of the manifold cap 103. In effect, the first orifices 140 deliver lubricant into the interior cap area 122, and from there, into the interior space 25 of the casing body 12. The first orifices 140 preferably have a circular cross-section, but it is understood that the first orifices may be of various shapes. The cross-sectional areas of the first orifices 140 are preferably between about 0.00075 $in^2$ (0.484 $mm^2$) and 0.20 $in^2$ (129 $mm^2$), but it is understood that the first orifices may be of various sizes, so long as they are suitable to deliver lubricant from the manifold chamber 113 to the interior space 25 of the casing body 12. The first orifices 140 are spaced around the 360-degree circumference 19 adjacent the lower end 17 of the casing body 12 preferably at intervals no greater than about 50% of the 360-degree circumference, more preferably at intervals no greater than about 40% of the 360-degree circumference, more preferably at intervals no greater than about 30% of the 360-degree circumference, more preferably at intervals no greater than about 25% of the 360-degree circumference, more preferably at intervals no greater than about 20% of the 360-degree circumference, more preferably at intervals no greater than about 15% of the 360-degree circumference, more preferably at intervals no greater than about 10% of the 360-degree circumference, and even more preferably at intervals no greater than about 5% of the 360-degree circumference. Moreover, the distance between adjacent orifices 140 is preferably between about 1 inch (2.54 cm) and 12 inches (30.5 cm) to provide an adequate amount of lubricant around the 360-degree circumference. It is understood, however, that this distance may vary without departing from the scope of this invention.

The outer wall 120 of the cap 103 has a plurality of second orifices 145 therein for delivering lubricant from the manifold chamber 113 to an exterior surface 146 of the outer wall 120 and, from there, onto the exterior surface 21 of the casing body 12 (FIGS. 8 and 10). The second orifices 145 have a circular cross-sectional, but it is understood that other shapes are possible. Preferably, the cross-sectional areas of these orifices 145 are between about 0.00075 $in^2$ (0.484 $mm^2$) and 0.20 $in^2$ (129 $mm^2$), but it is understood that the orifices may be of various sizes, so long as they are suitable to deliver lubricant from the manifold chamber 113 to the exterior surface 21 of the casing body 12. The second orifices 145 are spaced around the 360-degree circumference 19 adjacent the lower end 17 of the casing body 12 preferably at intervals no greater than about 50% of the 360-degree circumference, more preferably at intervals no greater than about 40% of the 360-degree circumference, more preferably at intervals no greater than about 30% of the 360-degree circumference, more preferably at intervals no greater than about 25% of the 360-degree circumference, more preferably at intervals no greater than about 20% of the 360-degree circumference, more preferably at intervals no greater than about 15% of the 360-degree circumference, more preferably at intervals no greater than about 10% of the 360-degree circumference, and even more preferably at intervals no greater than about 5% of the 360-degree circumference. Moreover, the distance between adjacent orifices 145 is preferably between about 1 inch (2.54 cm) and 12 inches (30.5 cm) to provide an adequate amount of lubricant around the 360-degree circumference. It is understood, however, that this distance may vary without departing from the scope of this invention.

As shown best in FIG. 10, the first orifices 140 preferably extend at an angle $A_1$ with respect a line, designated $l_1$, that extends generally transverse to the length L of the casing body 12 such that the first orifices intersect the manifold chamber 113 below the location where they intersect the inner side wall 118 of the manifold cap 103. Likewise, preferably the second orifices 145 extend at an angle $A_2$ with respect to the generally transverse line $l_1$ such that the second orifices 145 intersect the manifold chamber 113 below the location where they intersect the outer side wall 120 of the manifold cap 103. Angling the first and second orifices 140, 145, respectively, in this manner helps to lessen or substantially prevent a majority of earthen debris from clogging the orifices as the casing 100 is driven into the earthen surface. Preferably, the angles $A_1$ and $A_2$ are between about 0 degrees and 60 degrees.

The casing 100 of this embodiment is used in substantially the same way as the casing 10 shown in FIGS. 1-5. One notable difference, however, is that, as described above, the manifold cap 103 of the casing 100 forms the bottom (i.e., the tip) of the casing and, as a result, lubricant is ejected substantially at the tip of the casing where large frictional forces are generated.

Referring to FIGS. 11-13, a device of another embodiment of the present invention is generally indicated at 147. This device 147 is a pile comprising a solid pile body 148, and a manifold cap, generally indicated at 150, capping a lower end 149 of the pile body. Although it is not illustrated in the Figures, the pile 147 also includes a conduit that is essentially the same as the conduit 32 of the previously described embodiment, preferably having a cross-sectional area between about 0.2 $in^2$ (129 $mm^2$) and 1.75 $in^2$ (1129 $mm^2$). In the illustrated embodiment (FIGS. 11 and 12), the cap is H-shaped, corresponding to the cross-sectional shape of the associated pile body 148, and is sized to fit on the lower end 149 of the pile body. It is understood that the pile body 148 and the manifold cap 150 may have other shapes, such as Z-shaped (FIG. 13), L-shaped, or any other shape (conventional or otherwise). The manifold cap 150 of this particular embodiment comprises a pair of parallel end sections (FIG. 12), each generally indicated at 151, connected by a central web section, generally indicated at 152. Each section 151, 152 has a top 154, a tapered bottom 155, and opposing sides 157 defined by side walls 159 which are spaced apart to define a cavity 160. The cavities 160 of the three sections 151, 152 are connected to form a manifold chamber 161 in fluid communication with a port 168 through which lubricant is delivered to the chamber. Preferably, the manifold chamber 161 has a cross-sectional area between about 0.2 $in^2$ (129 $mm^2$) and 1.75 $in^2$ (1129 $mm^2$). Ends 162 of the end sections 151, 152 are closed to confine the chamber 161 within the cap 150. The opposing side walls 159 of each section 151, 152 have orifices 165 therein for delivery of lubricant to a periphery 167 (FIG. 13) of the cap 150. The tops 154 of the sections 151, 152 are slotted, as indicated at 180 (FIG. 13), for receiving the lower end 149 of the pile in a manner described in the previous embodiment. That is, the slot 180 is sized and shaped to receive a bottom surface 181 or edge of the pile body 148 (FIG. 11) such that the bottom surface of the pile body contacts ledges 174 extending from the side walls 159 into the manifold chamber 161 and the side walls extend up on the outside of the pile body. When the lower end 149 of the pile body 148 is received in the slot 180, an opening 182 in the top of the channel-shaped chamber 161 is closed.

In the embodiment of FIGS. 11-13, the orifices 165 in the spaced apart walls 159 of the cap 150 deliver lubricant from the manifold chamber 161 to the periphery 167 of the cap, and from there, to an exterior surface 187 of the pile body 148. The orifices 165 are preferably sized and shaped like the first and second orifices 140, 145, respectively, of the embodiment in FIGS. 6-10, although the orifices may be other sizes and shapes. The orifices 165 are preferably spaced around the perimeter of the manifold cap 150 preferably at intervals no greater than about 50% of the perimeter of the pile, more preferably at intervals no greater than about 40% of the perimeter of the pile, more preferably at intervals no greater than about 30% of the perimeter of the pile, more preferably at intervals no greater than about 25% of the perimeter of the pile, more preferably at intervals no greater than about 20% of the perimeter of the pile, more preferably at intervals no greater than about 15% of the perimeter of the pile, more preferably at intervals no greater than about 10% of the perimeter of the pile, and even more preferably at intervals no greater than about 5% of the perimeter of the pile. Moreover, the distance between adjacent orifices 165 is preferably between about 1 inch (2.54 cm) and 12 inches (30.5 cm) to provide an adequate amount of lubricant around the perimeter of the pile. It is understood, however, that this distance may vary without departing from the scope of this invention. The orifices 165 preferably extend at an angle $A_3$ (FIG. 13) with respect to a line $l_2$ generally transverse the length of the pile body 148 such that the orifices intersect the manifold chamber 161 below the location where they intersect the periphery 167 of the manifold cap 150.

This embodiment of the pile 147 of the present invention is used in substantially the same way as the previously discussed embodiments, except, of course, that there is no interior space being lubricated and no earthen core being formed.

Figure 14:
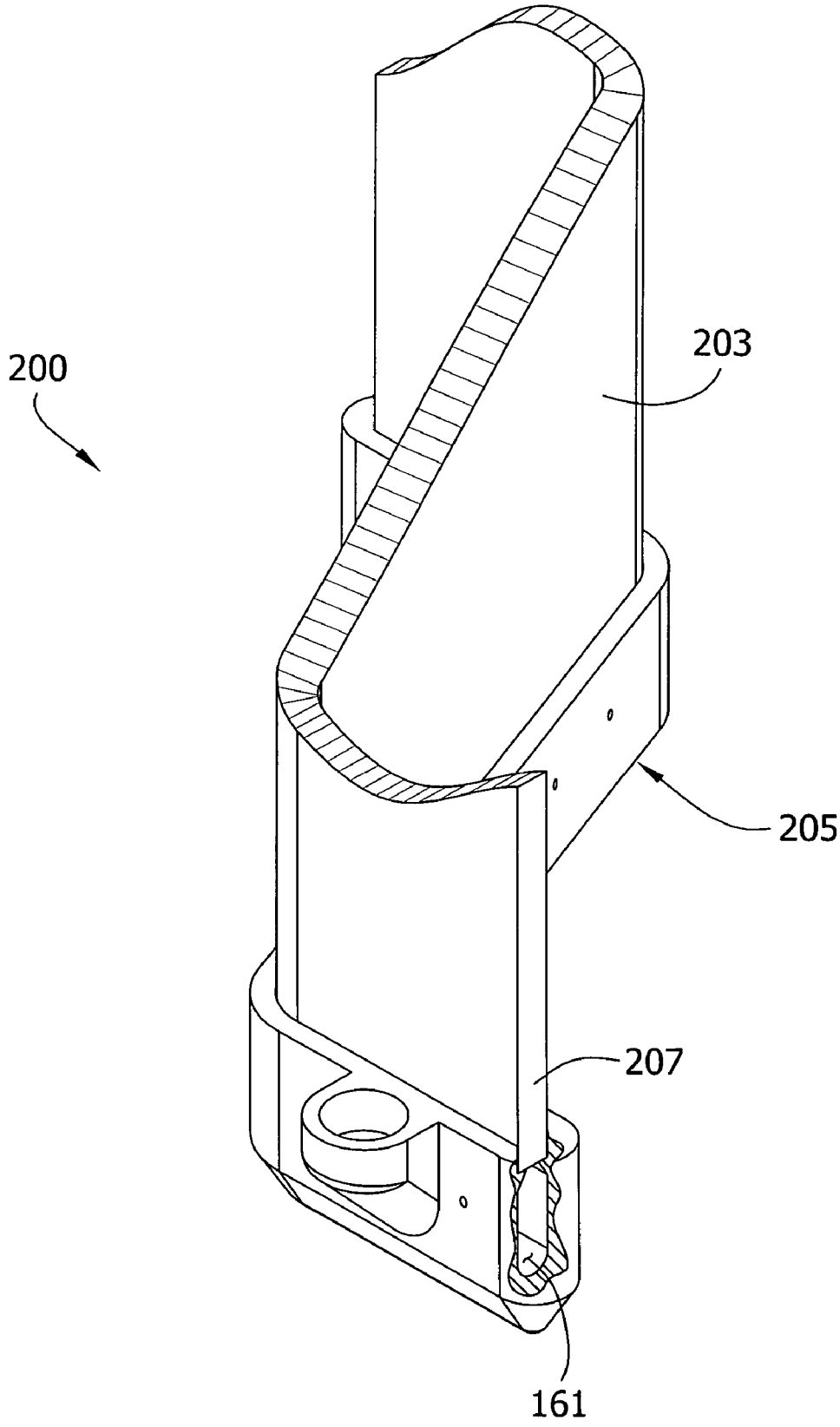
FIG. 14 is a fragmentary perspective of one embodiment of a Z-shaped pile.
Figure 15:
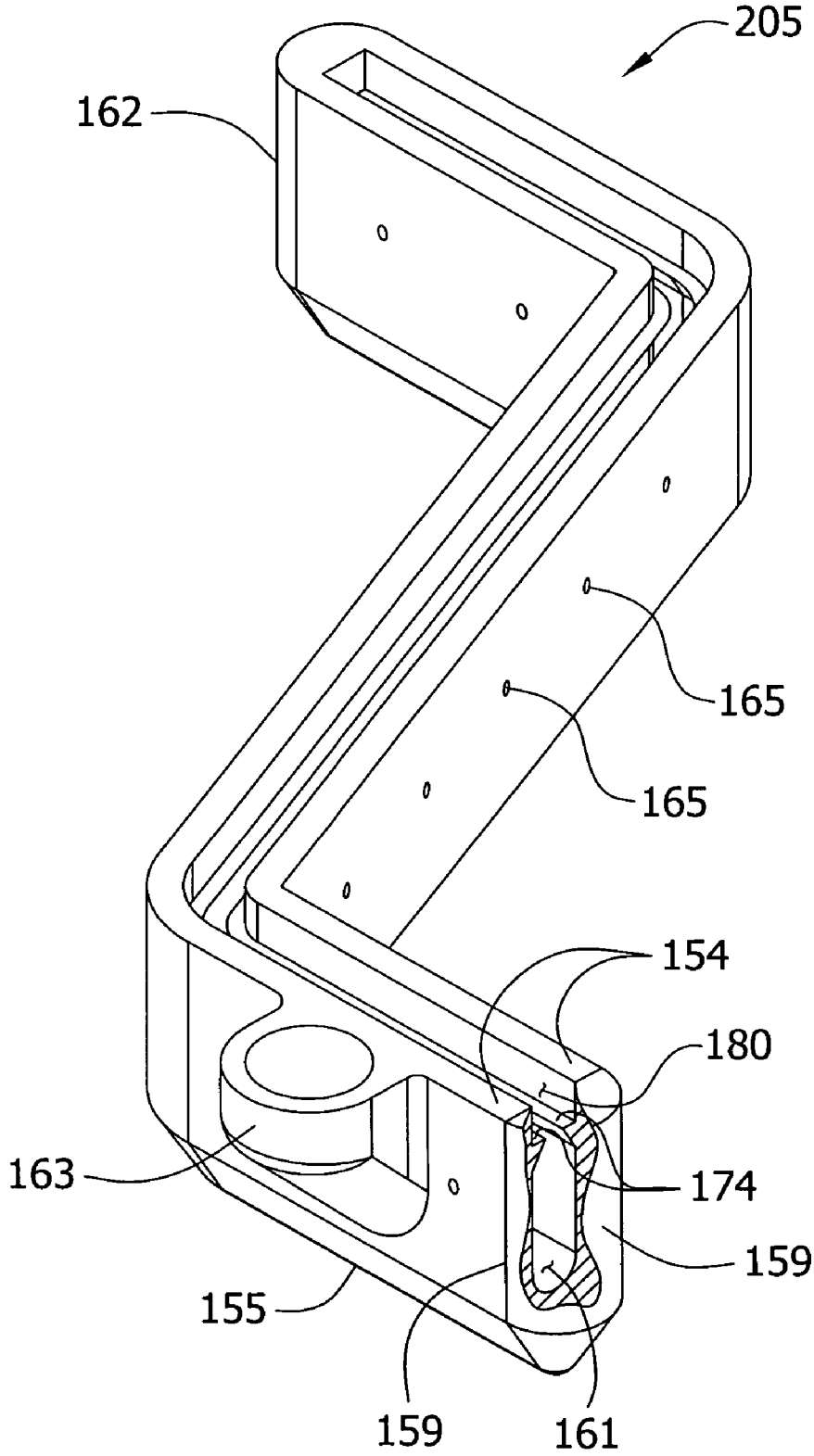
FIG. 15 is a perspective of a manifold cap of the Z-shaped pile of FIG. 14.

FIGS. 14-15 illustrate yet another pile embodiment of the present invention, generally indicated at 200. The pile 200 comprises a pile body 203 (FIG. 14) that is solid and generally Z-shaped and a manifold cap, generally indicated at 205, secured to a lower end 207 of the body. This embodiment is essentially the same as the H-shaped pile embodiment of FIGS. 11-13, except of course that the shapes of the pile body 203 and the manifold cap 205 are different from the shapes of the pile body 148 and manifold cap 150 of the embodiment of FIGS. 11-13. Because the manifold cap 205 shown in FIG. 15 is similar to the cap 150 shown in FIGS. 11-13, corresponding parts are indicated by corresponding reference numbers for convenience. The manifold chamber 161, the slot 180 for receiving the lower end 207 of the pile body 203, the tapered bottom 155, and the size, shape, relative position and relative location of the orifices 165 of this embodiment are essentially the same as the embodiment shown in FIGS. 11-13.

This embodiment is used in essentially the same way as the embodiment of FIGS. 11-13.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A pile casing for being driven into an earthen surface, comprising a tubular casing body having a length, an upper end, a lower end, a 360-degree circumference adjacent its lower end, an exterior surface, and an interior surface defining an interior space, and a lubrication system comprising:

a conduit for transferring lubricant running along the length of the casing body and having a first end adapted for fluid communication with a source of lubricant, and a second end;

a manifold adjacent the lower end of the casing body defining a manifold chamber disposed above the lower end of the casing body and extending around the exterior surface of the casing body in fluid communication with the second end of the conduit for flow of lubricant into the manifold chamber;

a plurality of first orifices extending from the manifold chamber through said exterior and interior surfaces of the tubular casing body to the interior space for delivery of lubricant from the manifold chamber to said interior space, said plurality of first orifices being spaced around the 360-degree circumference of the casing body at intervals no greater than about 50% of said 360-degree circumference; and a plurality of second orifices for delivery of lubricant from the manifold chamber to said exterior surface of the pile body, said plurality of second orifices being spaced around said 360-degree circumference of the casing body at intervals no greater than about 50% of said 360-degree circumference;

the arrangement being such that lubricant delivered to the manifold chamber is delivered through said pluralities of first and second orifices for distribution to said interior space and to said exterior surface of the casing body to facilitate driving of the casing.

2. The pile casing as set forth in claim 1 wherein each of said first and second orifices has a cross-sectional area between about 0.00075 in2 (0.484 $mm^2$) and 0.20 in2 (129 $mm^2$).

3. The pile casing as set forth in claim 2 wherein said second orifices extend through a top portion of said manifold generally adjacent the casing body.

4. The pile casing as set forth in claim 1 further comprising a lower protective guard attached around the exterior surface of the casing body below the manifold.

5. The pile casing as set forth in claim 4 wherein said lower protective guard has a thickness greater than or equal to a radius of said manifold.

6. The pile casing as set forth in claim 5 wherein said casing body, said manifold, said lower protective guard are formed from metal, wherein said manifold is welded to said casing body and to said lower protective guard, and wherein said lower protective guard is welded to said casing body.

7. The pile casing as set forth in claim 1 wherein the manifold comprises a hollow annular body extending around the exterior surface of the casing body in a plane generally transverse to the length of the pile casing body.

8. The pile casing as set forth in claim 7 wherein the hollow annular body of the manifold is formed from a round tubular bar.

9. The pile casing as set forth in claim 2 wherein said second orifices extend through a top portion of said manifold toward the casing body.

10. The pile casing as set forth in claim 4 further comprising an upper protective guard attached around the exterior surface of the casing body above the manifold.

11. The pile casing as set forth in claim 10 wherein a bottom surface of the upper protective guard is tapered.

12. The pile casing as set forth in claim 11 wherein said lower protective guard has a thickness greater than or equal to a radius of said manifold, and wherein said upper protective guard is vertically spaced from a top portion of the manifold and generally overlies said second orifices of the lubrication system.

* * * * *